United States Patent [19]

Moll et al.

[11] 4,052,215

[45] Oct. 4, 1977

[54] COLOR PHOTOGRAPHIC MULTILAYERED MATERIAL WITH IMPROVED COLOR DENSITY

[75] Inventors: Franz Moll, Leverkusen; Lothar Rosenhahn, Cologne, both of Germany

[73] Assignee: AGFA-Gevaert Aktiengesellschaft, Leverkusen-Bayerwerk, Germany

[21] Appl. No.: 739,581

[22] Filed: Nov. 8, 1976

[30] Foreign Application Priority Data

Nov. 11, 1975 Germany ..... 2550552

[51] Int. Cl.[2] ..... G03C 1/84; G03C 1/06; G03C 1/48

[52] U.S. Cl. ..... 96/84 R; 96/22; 96/59; 96/55; 96/95

[58] Field of Search ..... 96/55, 59, 89 R, 95, 96/22

[56] References Cited

U.S. PATENT DOCUMENTS

| | | | |
|---|---|---|---|
| 3,206,310 | 9/1965 | Herz | 96/97 |
| 3,361,565 | 1/1968 | Umberger | 96/84 R |
| 3,945,879 | 3/1976 | Zorn et al. | 96/84 R |
| 3,977,879 | 8/1976 | Bigelow | 96/95 |

*Primary Examiner*—Jack P. Brammer
*Attorney, Agent, or Firm*—Connolly and Hutz

[57] ABSTRACT

A color photographic material comprising at least one light-sensitive silver halide emulsion layer having preferably a non-diffusing color coupler associated to it and at least one non-lightsensitive binder layer containing a colloidal silver dispersion provides less contact fog and a better color reproduction if the non-lightsensitive binder layer containing the colloidal silver dispersion contains also a soluble iodide, particularly sodium, potassium or ammonium iodide. Alternatively the soluble iodide may also be contained in a non-lightsensitive binder layer adjacent that binder layer which contains the silver dispersion.

3 Claims, No Drawings

COLOR PHOTOGRAPHIC MULTILAYERED MATERIAL WITH IMPROVED COLOR DENSITY

This invention relates to a colour photographic multilayered material containing filter layers of colloidal silver, in which materail soluble iodides are added to the filter layers to prevent contact fog in adjacent silver halide layers.

For various purposes, colour photographic films have filter layers containing colloidal silver arranged adjacent to the individual light-sensitive silver halide emulsion layers. Thus, for example, the auxiliary layer between the blue sensitive and the green sensitive silver halide layer may contain yellow colloidal silver. This yellow filter layer serves to keep the unwanted blue portion of light away from the red sensitive and green sensitive emulsion layers. An anthihalation auxiliary layer between the support layer and the immediately adjacent silver halide layer may comprise black, brown or blue colloidal silver. A covering layer may also contain coloured colloidal silver for correcting the colour reproduction. The colloidal silver is removed from the photographic material during the photographic process by being first converted into silver halide in the bleaching bath and then dissolved in the fixing bath.

These various layers containing colloidal silver frequently have a hramful effect on the adjacent emulsion layers, particularly if the colour photographic materials are treated with developers which contain substances which function as complex formers for the silver halide in the emulsion layers, for example alkali metal thiocyanates, amine compounds or substantial quantities of sulfphites and alkali metal halides. These complex formers may give rise to physical development on the colloidal silver particles in the auxiliary layers.

The effect of these silver particles may vary in intensity according to the "activity" of the surface of these particles. The effect of these particles is to increase the colour fog in colour negative materials and the quantity of fogging silver in colour reversal materials in the first developer, so that the colour density produced by subsequent colour development is reduced accordingly. These deleterious phenomena are known as contact fog. The measures hitherto adopted for preventing contact fog have numerous disadvantages, for example the incorporation of separating layers which contain gelatine between the layer which contains colloidal silver and the light-sensitive silver halide emulsion layers only incompletely prevents contact fog but reduces the image sharpness and increases the fragility of the film material due to the greater total thickness of the material.

Attempts to prevent contact fog by the action of reducing agents on colloidal silver (see Grechko and Wilenski, Sci. et Ind. phot. 2, 32, page 437) also failed to yield any useful practical results. In some cases, this method even caused fogging and desensitization of the adjacent emulsion layers.

In U.S. Pat. No. 3,206,310 derivatives of benzothiazole and benzoselenazole have been described as additives for colloidal silver to prevent contact fog. These substances, however, are effective only if they are left to react with the colloidal silver solution for some time at a particular pH before the solution is cast. It is assumed that the benzothiazole or benzoselenazole ring is decomposed by hydrolyis to form a free thiol compound which is regarded as the active substance capable of suppressing contact fog.

According to German Auslegeschrift No. 1,168,251, triazaindolizines are used to suppress the troublesome effect of the yellow filter layer which contains colloidal silver.

It is an object of the present invention to reduce the activity of colloidal silver in colour photographic multilayered materials which have auxiliary layers containing colloidal silver, e.g. filter or antihalation layers, and thus effectively to prevent the formation of contact fog in these auxiliary layers.

It has been found that this can be achieved by adding soluble iodides, in particular alkali metal iodides or ammonium iodide, to the auxiliary layers containing colloidal silver or to light insensitive auxiliary layers adjacent thereto.

The invention relates to a colour photographic material comprising at least one light-sensitive silver halide emulsion layer and at least one light insensitive auxiliary layer containing a colloidal silver dispersion, for example a filter layer or antihalation layer, characterised in that the layer which contains the colloidal silver dispersion or a light insensitive auxiliary layer adjacent thereto contains a soluble iodide, preferably an alkali metal (sodium, potassium) iodide or ammonium iodide.

The aforesaid auxiliary layers are light-insensitive layers consisting substantially of a hydrophilic binder. They may contain light-insensitive additives, e.g. developer compounds, stabilizers, silver salt solvents or compounds for binding diffusible developer oxidation products. In the materials used according to the present invention, at least one of the aforesaid auxiliary layers contains a colloidal silver dispersion.

The soluble iodides are added to the casting solutions for the auxiliary layers in which they are required, for example the casting solution for the layer containing colloidal silver or the casting solution for the adjacent auxiliary layer. The quantity of soluble iodide added to a colloidal silver layer is from 50 mg to 50 g per mol of silver, preferably 200 mg to 5 g per mol of silver. Larger quantities may also be used but in some bleaching baths this may give rise to difficulties in bleaching the silver. Moreover, the addition of excessive quantities of soluble iodides is liable to impair the sensitivity to light of the silver halide layers adjacent to the colloidal silver layer.

If the soluble iodides are added to casting solutions for the auxiliary layer adjacent to the colloidal silver layer, the quantities used are from 1 mg to 30 mg per $m^2$, preferably 5 to 100 mg per $m^2$.

This invention relates to conventional colour photographic materials which generally contain at least three differently sensitised silver halide emulsion layers, namely a red-sensitive, a green-sensitive and a blue-sensitive silver halide emulsion layer. In general, the blue-sensitive layer forms the uppermost light-sensitive silver halide emulsion layer, the green sensitive layer is situated below it to form the middle layer while the red sensitive layer is situated lowermost, but other arrangements of layers can also be used. When colour development is carried out in the presence of colour couplers, partial colour images complementary to the given spectral sensitivity are produced in the individual silver halide emulsion layers. Colour development may be carried out by the so-called bathing-in method of development in which soluble colour couplers are used in the colour developer baths but it is preferred to use colour photographic materials in which each light-sensitive silver halide emulsion layer is associated with a non-diffusible compound for producing an image dye of a colour which is generally complementary to the spectral sensitivity. These compounds may be ordinary colour couplers. The red sensitive layer, for example, contains a non-diffusible colour coupler for producing the cyan partial colour image, generally a coupler based on phenol or α-naphthol. The green sensitive layer contains a non-diffusible colour coupler for producing the magenta partial colour image, generally a colour coupler based on 5-pyrazolone or indazolone. The blue sensitive layer unit, finally, contains a non-diffusible colour coupler for producing the yellow partial colour image, generally a colour coupler containing open chain keto methylene groups. Large numbers of colour couplers of these kinds are known and have been described in numerous patent specifications, for example in the publication entitled "Farbkuppler" by W. Pelz in "Mitteilungen aus den Forschungslaboratorien der Agfa, Leverkusen/Munchen", Volume III (1961) and the publication by K. Venkataraman in "The Chemistry of Synthetic Dyes", Vol. 4, 341 to 387, Academic Press, 1971.

The non-diffusible colour couplers may contain a removable substituent in the coupling position so that they only require two equivalents of silver halide to produce the colour, in contrast to the usual 4-equivalent couplers. The colour couplers are generally themselves colourless, but if the removable substituent contains a chromophoric group, as in the case of the known masking couplers, then the colour couplers generally have a colour which is suitable for masking unwanted side densities of the image dye by the usual masking techniques. The image dyes produced from colour couplers are generally resistant to diffusion.

In addition, there may also be used non-diffusible white couplers which react with colour developer oxidation products but do not produce a dye, or DIR couplers which react in the colour development process to produce a dye and at the same time liberate a diffusible development inhibitor, or there may also be used coupler-like compounds such as DIR coupounds. The last mentioned react with colour developer oxidation products to release a development inhibitor without contributing to the form of the colour image by production of a stable dye. Compounds of this kind have been described, for example, in U.S. Pat. No. 3,632,345.

The non-diffusible colour couplers are added to light-sensitive silver halide emulsions or other casting solutions by the usual, known methods. If the compounds are water-soluble or alkali soluble, they may be added to the emulsions in the form of aqueous solutions, to which water-miscible organic solvents such as ethanol, acetone or dimethylformamide may be added. If, on the other hand, the non-diffusible colour couplers or development inhibitor releasing compounds are insoluble in water or alkalies, they may be emulsified in known manner, for example by preparing a solution of the compounds in a low boiling organic solvent and mixing the solution either directly with the silver halide emulsion or first with an aqueous gelatine solution and then removing the organic solvent in the usual manner. An emulsion of the given compound in gelatine prepared in this way is subsequently mixed with the silver halide emulsion. If desired, so-called coupler solvents or oil formers may be used to assist emulsification of such hydrophobic compounds. These oil formers are generally higher boiling organic compounds in which the development inhibitor releasing compounds and non-diffusible colour coupler required to be emulsified in the silver halide emulsions become enclosed in the form of oily droplets. Reference may be made in this connection, for example, to U.S. Pat. Nos. 2,322,027; 2,533,514; 3,689,271; 3,764,336 and 3,765,897. The couplers may also be converted into aqueous dispersions and added in this form to the given casting solutions. To obtain these dispersions, aqueous mixtures of the colour couplers are finely milled, for example by vigorous stirring with the addition of sharp edged sand or with the aid of ultrasound.

The usual silver halide emulsions are suitable for the present invention. They may contain silver chloride, silver bromide or mixtures thereof, and may have a silver iodide content of up to 20 mol %. They may be either ordinary negative emulsions or direct positive emulsions e.g. emulsions which have a high sensitivity in the interior of the silver halide grains, for example emulsions of the kind described in U.S. Pat. No. 2,592,250.

The binder used for the photographic layers is preferably gelatine but this may be partly or completely replaced by other natural or synthetic binders. Suitable natural binders include, for example, alginic acid and its derivatives such as its salts, esters or amides, cellulose derivatives such as carboxymethylcellulose, alkylcelluloses such as hydroxyethylcellulose, starch or its derivatives such as ethers or esters or carrageenates. Suitable synthetic binders include polyvinyl alcohol, partially saponified polyvinyl acetate, polyvinyl pyrrolidone and the like.

The preparation of various types of colloidal silver has been described in the literature, for example in Collodial Elements by Weiser, Wiley & Sons, New York, 1933, which concerns the preparation of yellow colloidal silver by the dextrine reduction method of Carey Lea, or in German Patent Specification No. 1,096,193 (colloidal brown and black silver) or in U.S. Pat. No. 2,688,601 (colloidal blue silver). German Offenlegungsschrift No. 1,917,745 is also relevant in this context.

Yellow colloidal silver, for example, is used to prepare the yellow filter layer arranged between the blue sensitive silver halide emulsion layer at the top and the green sensitive silver halide emulsion layer underneath it. Dark colloidal silver, e.g. brown or black colloidal silver, is used in colour photographic materials for producing original copies, in which it is arranged in a layer situated between the substrate and the lowermost light-sensitive silver halide emulsion layer. This colloidal silver layer acts as antihalation layer and makes a considerable contribution to the sharpness of the image.

The silver particles in the colloidal silver dispersions are active centres or nuclei for physical development. When development is carried out in the presence of silver halide solvents such as alkali metal thiocyanates, amine compounds or substantial quantities of sulphites, part of the silver halide is dissolved as a complex and physically developed in the layer with the colloidal silver dispersion. This is an undesirable effect and is all the more pronounced the more highly active the silver dispersion. In the case of colour development, an unwanted colour fog is produced in the layer containing the colloidal silver dispersion, and this fog is all the more pronounced the more highly active the silver dispersion.

For producing positive colour images, the colour photographic material which has been exposed imagewise is first subjected to a process of black-and-white development (first development) and then to a reversal fogging treatment followed by colour development (second development). The first developer used is a pure black-and-white developer which generally contains substantial quantities of the silver halide solvent, e.g. potassium thiocyanate. Reversal fogging treatment generally consists of uniform exposure by which the silver halide which has not been developed by the first development is rendered developable. Instead of this reversal exposure, one may also carry out a treatment with a chemical fogging agent. Second development is carried out using a conventional colour developer which chromogenically develops the silver halide which has been rendered developable by the reversal fogging treatment. In this reversal treatment, physical development in the layer containing the silver dispersion has the particularly troublesome effect of reducing the colour density. The silver halide which has been physically developed by the first development in the silver dispersion layer is, of course, lost for the second development and consequently the colour yield is all the more severely reduced the more highly active the silver dispersion. This phenomenon has previously been counteracted by increasing the concentration of silver in the layer but, apart from the disadvantage of increasing the silver consumption, this had the further disadvantage of increasing the thickness of the layer and hence reducing the sharpness of the image.

According to the present invention, the activity of the silver dispersion is reduced by the addition of soluble iodides. This results in a considerable increase in the colour yield in chromogenic development. If the concentration of silver in the layer is kept constant, the maximum colour density achieved by colour development can therefore be used as a measure of the activity of the silver dispersion and hence of the effectiveness of the addition of iodide.

The invention will now be explained with the aid of the following Examples.

EXAMPLE 1

A black silver sol was prepared by the method according to German OS No. 1,917,745, Example 1, V. When its preparation had been completed, it contained 51 g of silver and 100 g of gelatine per kg.

The gelatine/silver sol dispersion was divided into 6 portions and mixed with the additives shown in the following Table:

| Portion | Additive | mg/kg of dispersion |
|---|---|---|
| A | 0 | 0 |
| B | potassium iodide | 1500 mg |
| C | potassium iodide | 500 |
| D | potassium iodide | 250 |
| E | Triazaindolizine | 500 |
| F | potassium bromide | 2000 |

The dispersions were cast on a cellulose acetate substrate to form layers containing 0.61 g of silver per m². A red sensitized, high sensitivity silver iodobromide emulsion was applied to these layers. The emulsion contained 6 mol % of iodide and, per kg of emulsion, it contained 36 g of silver halide and 24 g of a cyan coupler of the following formula

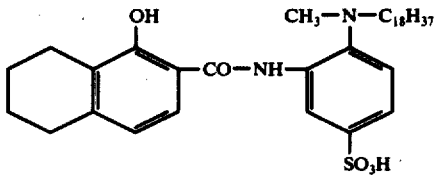

The silver application was 0.57 g/m².

Each sample was exposed behind a continuously graded grey wedge and developed by a reversal process as described below.

PROCESSING AT 20° C:

Black-and-white development: 7 minutes in a developer consisting of:

300 ml of distilled water;
2 g of sodium hexametaphosphate;
2.3 g of p-N-monomethylaminophenol;
50 g of sodium sulphite (anhydrous);
6.6 g of hydroquinone;
50 g of sodium carbonate (anhydrous);
3.5 g of potassium thiocyanate;
1.8 g of potassium bromide;
0.008 g of potassium iodide; made up to 1000 ml with water, pH = 10.

Short stop bath: 5 minutes in a solution of:

300 ml of distilled water;
30 g of sodium acetate (crystalline);
5 ml of acetic acid;
made up to 1000 ml with water, pH = 5.

Rinsing: 10 minutes.

Diffuse reversal exposure: 2 minutes.

Colour development: 18 minutes in a colour developer consisting of:

300 ml of distilled water;
2 g of nitrilotriacetic acid;
3.5 g of N,N-diethyl-p-phenylenediamine;
20 g of trisodium phosphate;
0.7 g of potassium bromide;
0.8 g of hydroxylamine; made up to 1000 ml with water, pH = 11.7.

Rinsing: 5 minutes.

Bleaching bath: 5 minutes in a bleach bath consisting of:

8 g of potassium ferricyanide;
20 g of potassium bromide and
12 g of disodium phosphate;
made up to 1000 ml with water and adjusted to pH = 5.2 with acetic acid.

Rinsing: 5 minutes.

Fixing: 5 minutes in a fixing bath consisting of:

150 g of ammonium thiosulphate;
10 g of sodium sulphite (anhydrous);
2 g of sodium hexamethaphosphate; made up to 1000 ml with water, pH = 7.

Final rinsing: 5 minutes.

Sensitometric examination indicated the colour yields shown below. The colour yield is the quotient of the maximum colour density and the quantity of silver applied, calculated as silver nitrate.

The following values were obtained:

| Sample | Additive | Colour Yield |
|---|---|---|
| A | None | 1.25 |
| B | 1500 mg of iodide | 1.75 |
| C | 500 mg of iodide | 1.45 |
| D | 250 mg of iodide | 1.35 |
| E | 500 mg of triazaindolizine | 1.28 |
| F | 2000 mg of bromide | 1.25 |

The examples show that the activity of the silver sol can be varied within wide limits by the addition of soluble iodides and that iodides are far superior to other additives in this respect.

EXAMPLE 2

A silver sol dispersion was cast on a substrate without the addition of iodide as described in Example 1. A gelatine layer was applied to this substrate in a thickness of 1 μm but differing quantities of potassium iodide had been added to the gelatine solution. A silver halide emulsion containing the additives described in Example 1 was applied to this gelatine layer as described in Example 1. After development as described in Example 1, sensitometric examination yielded the following results:

| Sample | Substance added | mg/m² | Colour yield |
|---|---|---|---|
| A | none | 0 | 1.28 |
| B | potassiumiodide | 10 | 1.41 |
| C | potassiumiodide | 50 | 1.92 |

These examples show that the activity of the silver sol can be widely varied by the addition of potassium iodide.

We claim:

1. In a color photographic material comprising at least one lightsensitive silver halide emulsion layer and at least one light-insensitive layer of binder containing a colloidal silver dispersion the improvement according to which the light-insensitive layer of binder containing the colloidal silver dispersion or a light-insensitive layer of binder adjacent thereto contains an alkali metal iodide or ammonium iodide.

2. The color photographic material as claimed in claim 1, in which the light-insensitive layer of binder containing the colloidal silver dispersion contains said iodide in a quantity of from 50 mg to 50 g/mol of colloidal silver.

3. The color photographic material as claimed in claim 1, in which the light-insensitive layer of binder adjacent to the layer of binder which contains the colloidal silver dispersion contains said iodide in a quantity of from 1mg to 300 mg per m².

* * * * *